United States Patent [19]

Rannou

[11] 4,031,487

[45] June 21, 1977

[54] RECIPROCAL MICROWAVE JUNCTION DEVICE

[75] Inventor: Jean Rannou, Paris, France

[73] Assignee: Thomson-CSF, Paris, France

[22] Filed: Jan. 28, 1976

[21] Appl. No.: 653,022

[30] Foreign Application Priority Data

Jan. 31, 1975 France ..... 75.03101

[52] U.S. Cl. ..... 333/1; 333/9.97 R

[51] Int. Cl.[2] ..... H01P 5/00; H01P 3/06

[58] Field of Search ..... 333/6, 8, 9, 11, 26, 333/97 R, 1

[56] References Cited

UNITED STATES PATENTS 3,827,001 7/1974 Laughlin ..... 333/9

FOREIGN PATENTS OR APPLICATIONS 185,977 10/1966 U.S.S.R. ..... 333/9

*Primary Examiner*—Paul L. Gensler

*Attorney, Agent, or Firm*—Edwin E. Greigg

[57] ABSTRACT

The present invention relates to reciprocal junction devices between independent coaxial lines and concentric coaxial lines. As many elementary junctions as there are independent lines, less one, are required. Each elementary junction involves a two-wire line zone and two parts which establish a progressive transition between the two-wire line and, at one end, the independent coaxial line and, at the other end, the concentric coaxial lines.

4 Claims, 4 Drawing Figures

RECIPROCAL MICROWAVE JUNCTION DEVICE

The present invention relates to junction devices between a system of independent coaxial lines and a system of concentric coaxial lines.

The system of two or more concentric coaxial lines is widely used in microwave systems containing rotating joints. It makes it possible to transmit two or more independent transmission channels between a fixed component and a component rotating about the axis of the system of concentric coaxial lines.

The utilisation of concentric coaxial lines of this kind, involves difficulties where the design of the junctions between concentric coaxial lines and independent coaxial lines, and vice versa, is concerned. The devices most widely used to effect these junctions employ either junctions between coaxial lines and circular-section or rectangular-section waveguides, or sets of coaxial lines in a Tee arrangement, one of the branches of which picks off the signals transmitted through the two external conductors, and the other those transmitted through the internal conductors.

However, these devices cannot operate without impedance matching and tuning devices, which reduce the frequency band of the signals transmitted by the external line. The bandwidth of systems of this sort, is restricted to one octave.

One object of the present invention is to provide a wideband junction device.

In accordance with one feature of the invention, there is provided a reciprocal microwave junction device between a system of independent coaxial lines and a system of concentric coaxial lines, comprising as many elementary junctions as there are independent lines, less one, each of said junctions comprising a first part in which two independent lines are joined in parallel with one another, their external conductors being connected together, a second part for establishing a progressive transition from the assembly of two parallel lines to a two-wire line having a first conductor constituted by one of the lines and the other by the internal conductor of the other line, and a third part for establishing a progressive transition from said two-wire line to the system of concentric coaxial lines whose internal conductor is constituted by said first conductors of the two-wire line, and whose external conductor is connected to the other conductor of the two-wire line.

The invention will be better understood from a consideration of the ensuing description, illustrated by the figures where :

FIG. 1 illustrates an example of a junction device in accordance with the invention, between two independent coaxial lines and a system of concentric lines carrying two channels.

Figure 1:
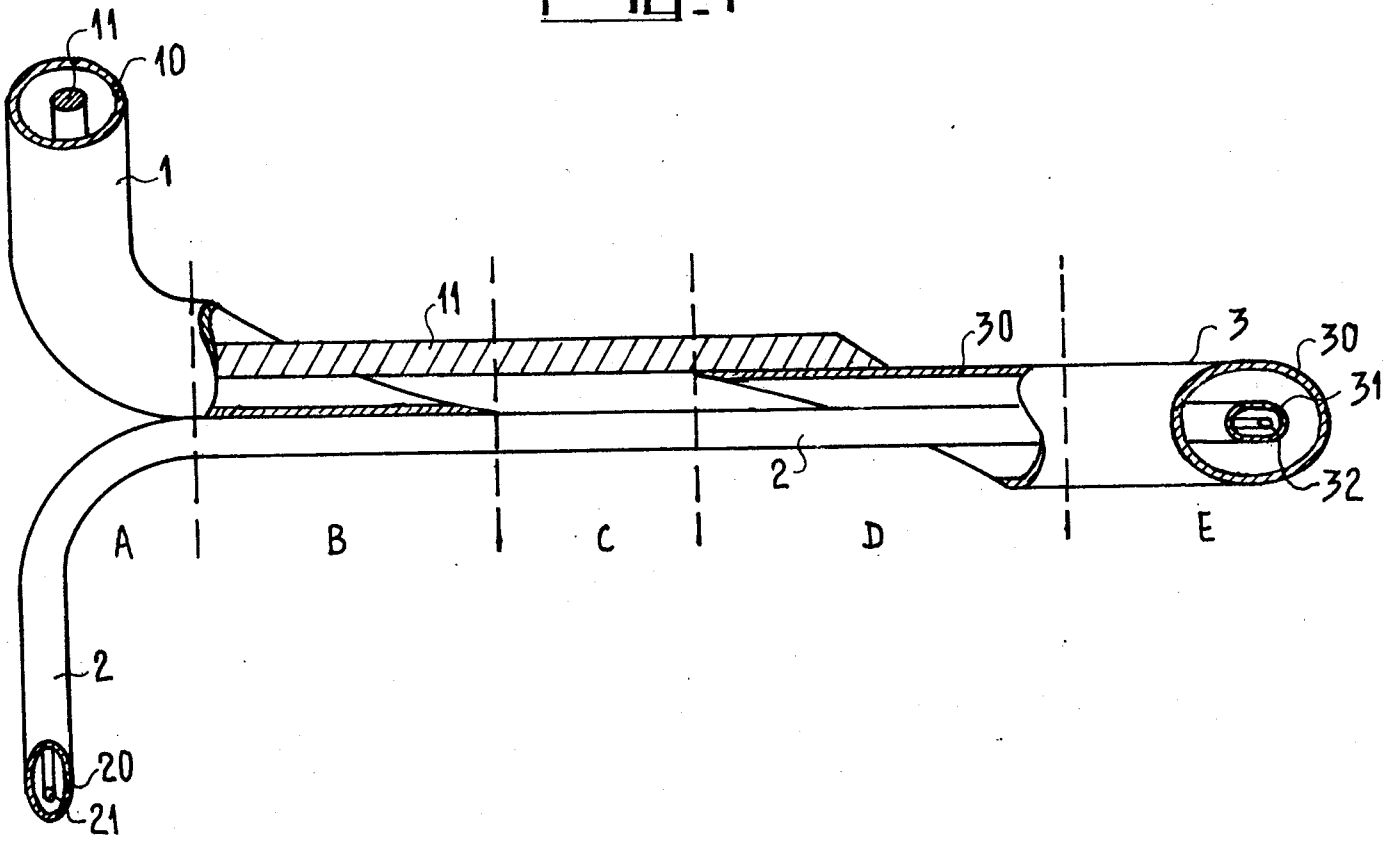
FIG. 1 is an example of a junction between two independent coaxial lines and two concentric lines, in accordance with the invention.

The two independent coaxial lines respectively carry the references 1 and 2, and the concentric line the reference 3.

In the figure, the device is divided into five separate parts respectively marked A, B, C, D and E. The part A is constituted by the two independent coaxial lines 1 and 2. The coaxial lines merge and are then connected. The line 1 comprises an external conductor 10 and an internal conductor 11. The line 2 also comprises an external conductor 20 and an internal conductor 21. Part E, at the other end of the device, comprises the system of concentric coaxial lines 3. This incorporates an external conductor 30 connected to the internal conductor 11 of the line 1, an intermediate conductor 31 which is the extension of the external conductor 20 of the line 2, and an internal conductor 32 which is the extension of the internal conductor 21 of the line 2.

In fact, the line 2 remains intact from one end of the device to the other. The part B constitutes a progressive transition from the coaxial lines to a two-wire line, which makes it possible to expose the central conductor 11 of the coaxial line 1. The line 1 is cut on the slant and only its internal conductor extends onwards into the parts C and D. The external conductor 20 of the line 2 is then soldered to the external conductor 10. The line 2 constitutes one of the conductors and the conductor 11 the other, of the two-wire line corresponding to part C. The part D is once again a progressive transition from two-wire line to coaxial line, but in this case the coaxial line 2 becomes the central conductor 31 of the coaxial line 3, and the internal conductor 11 of the coaxial line 1 is soldered to the external conductor 30 of the coaxial line 3. The part E is a "triax" line. An identical but reciprocal device connected to the part E, makes it possible to change back to the system of independent coaxial lines.

The coaxial line 2 passes unbroken from A to E so that there is no limitation on pass-band. On the other hand, in the case of the coaxial line 1, the pass-band is limited only by the efficiencies of the progressive transitions B and D, and of the two-wire line C.

However, it is well-known that this kind of progressive transition has a wide-band characteristic if its length is sufficiently long compared with the wave length. Thus, there is no limitation towards the higher frequencies to the extent that the two-wire zone C is constituted by sufficiently fine and closely spaced lines to prevent any radiation from them.

To avoid proximity effects at the locations of the progressive transitions, and at the two-wire line, it is desirable to enclose the zone B, C, D in a cylindrical metal screening of diameter greater than that of the coaxial line 1. The ends of the screened zone will preferably be filled with an absorbent material to prevent the development of any resonance condition.

Figure 2:
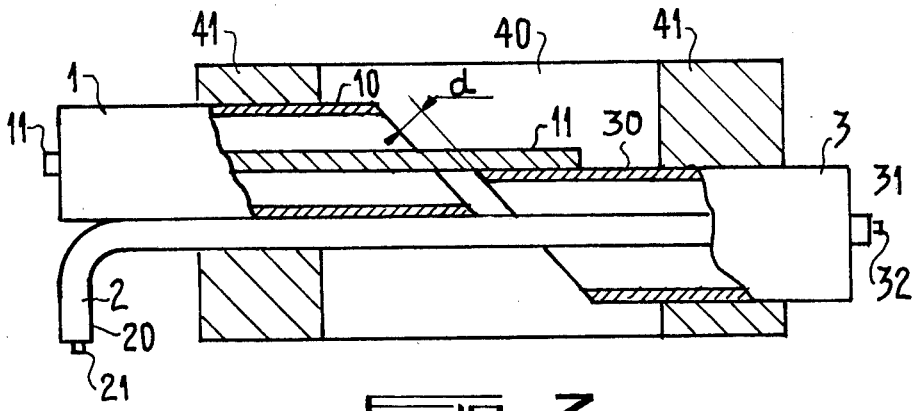
FIGS. 2, 3 and 4 illustrate variant embodiments of the invention.
Figure 3:
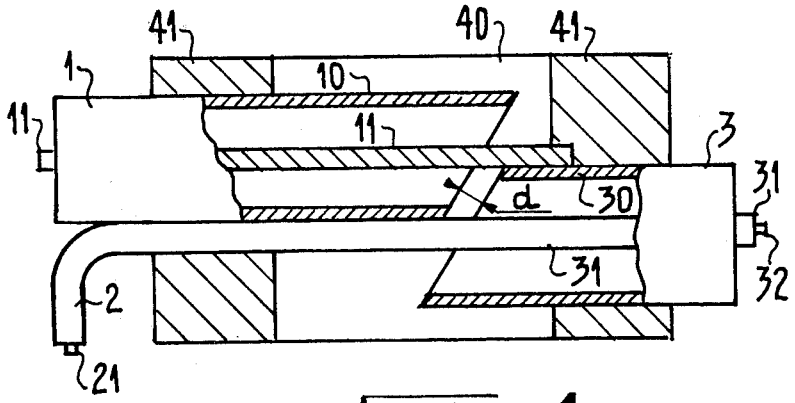
Figure 4:
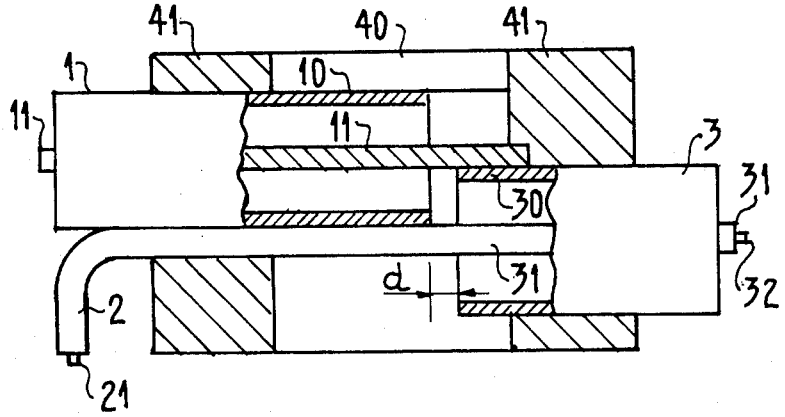

This is precisely what has been shown in FIGS. 2, 3 and 4 which are variant embodiments of FIG. 1.

Commencing in all cases from two progressive junction and a two-wire line section, it is possible to shorten the device in accordance with the invention to a maximum extent.

In FIG. 2, the two-wire section is shortened to the maximum extent. The two progressive junctions are spaced apart by an interval d the adjustment of which enables correct operation to be achieved.

As stated earlier, a screening 40 encloses the device and the screen, at its ends, contains an absorber 41.

In FIG. 3, the direction of the cutting of the lines 1 and 3 which form the progressive junction, is reversed to that the junction device can be still further shortened whilst continuing to leave a suitable interval d.

In FIG. 4, the lines 1 and 3 are no longer cut on the slant but at right angles. The properties of the system are substantially the same as those of the device shown in FIG. 3.

In FIGS. 3 and 4, adjustment of the dimension d makes it possible to achieve correct operation within a frequency band the ratio between whose top and bottom frequencies is better than 5.

Self-evidently, junction devices between 3, 4 or a large number of lines and a system of concentric lines, are possible and will be constituted by a series of successive junctions of the kind shown in FIGS. 1 to 4. In each junction, the preceding concentric line becomes the internal conductor of a new line which has an extra external conductor. The diameter of the concentric line increases as the number of lines increases.

The device in accordance with the invention is a reciprocal device. It makes it possible to effect junctions from independent coaxial lines to concentric coaxial lines and vice versa.

It has particularly interesting applications in association with a rotary joint or joints, these latter only being able to carry several radio signals through a system of concentric coaxial lines. Devices in accordance with the invention are then arranged between the independent lines up-circuit and down-circuit of the rotary joint or joints, and the latter itself or themselves.

The invention applies equally to surveillance radar systems where the need to transmit and receive signals simultaneously in several frequency bands, is translated by a need for the provision of concentric coaxial transmission lines.

What is claimed is:

1. A reciprocal microwave junction device between a system of concentric coaxial lines having an external conductor and an internal coaxial line, and a first and a second independent coaxial line each having an internal conductor and an external conductor, said junction device comprising:

a section of two parallel wires transmission line having a first wire formed of a common section of the first independent coaxial line and the internal coaxial line of the concentric coaxial line system, and a second wire formed of an extension of the internal conductor of the second independent coaxial line, said first and second coaxial line being located adjoining and parallel to one another at one end of said device, the external conductor of said second independent coaxial line terminating at said end and making electrical contact with said first line external conductor, said concentric coaxial line system being located at the other end of said device in prolongation of the first coaxial line, the external conductor of said concentric coaxial line system terminating at said other end and making electrical contact with said second line internal conductor.

2. A junction device as claimed in claim 1, wherein each progressive transition between the two parallel coaxial lines and the two-wire line involves a slanting out in the external conductor of one of the coaxial lines, in order to expose its internal conductor.

3. A junction device as claimed in claim 1, further comprising a metallic screen for enclosing the two progressive transitions and the two-wire line.

4. A junction device as claimed in claim 3, wherein the ends of the zone enclosed in said screen are filled with an absorptive material.

* * * * *